US009530311B2

(12) United States Patent
Lee

(10) Patent No.: US 9,530,311 B2
(45) Date of Patent: Dec. 27, 2016

(54) TRAFFIC INFORMATION DETECTION SYSTEM AND METHOD THEREOF

(71) Applicant: Jeong Jun Lee, Gunpo-Si Gyeonggi-Do (KR)

(72) Inventor: Jeong Jun Lee, Gunpo-Si Gyeonggi-Do (KR)

( * ) Notice: Subject to any disclaimer, the term of this patent is extended or adjusted under 35 U.S.C. 154(b) by 0 days.

(21) Appl. No.: 13/748,571

(22) Filed: Jan. 23, 2013

(65) Prior Publication Data

US 2014/0028475 A1 Jan. 30, 2014

Related U.S. Application Data

(63) Continuation-in-part of application No. 12/298,296, filed as application No. PCT/KR2007/002114 on Apr. 30, 2007, now abandoned.

(30) Foreign Application Priority Data

May 11, 2006 (KR) ..... 10-2006-0042503

(51) Int. Cl.

| | |
|---|---|
| ***G08G 1/01*** | (2006.01) |
| ***G08G 1/042*** | (2006.01) |
| ***G08G 1/015*** | (2006.01) |
| ***G08G 1/052*** | (2006.01) |

(52) U.S. Cl.

CPC ..... *G08G 1/042* (2013.01); *G08G 1/015* (2013.01); *G08G 1/052* (2013.01)

(58) Field of Classification Search

CPC ..... G08G 1/01; G08G 1/042
USPC ..... 340/910, 917, 933, 941; 701/117–119
See application file for complete search history.

(56) References Cited

U.S. PATENT DOCUMENTS

| | | | | |
|---|---|---|---|---|
| 4,999,604 | A * | 3/1991 | Crews | 340/323 R |
| 5,748,108 | A | 5/1998 | Sampey et al. | |
| 5,880,682 | A * | 3/1999 | Soulliard et al. | 340/907 |
| 6,483,443 | B1 | 11/2002 | Lees et al. | |
| 6,611,210 | B2 | 8/2003 | Hilliard et al. | |
| 6,662,099 | B2 | 12/2003 | Knaian | |
| 6,672,018 | B2 * | 1/2004 | Shingleton | 52/173.3 |
| 6,744,378 | B1 | 6/2004 | Tyburski | |
| 6,750,787 | B2 * | 6/2004 | Hutchinson | 340/942 |
| 7,230,546 | B1 * | 6/2007 | Nelson et al. | 340/933 |

(Continued)

FOREIGN PATENT DOCUMENTS

| | | |
|---|---|---|
| KR | 100317306 | 11/2001 |
| KR | 1020040100349 | 12/2004 |

OTHER PUBLICATIONS

International Search Report for PCT/KR2007/002114 mailed Aug. 20, 2007.
U.S. Appl. No. 12/298,296, filed Apr. 30, 2007.

*Primary Examiner* — Brent Swarthout
(74) *Attorney, Agent, or Firm* — STIP Law Group, LLC

(57) ABSTRACT

A traffic information detection system and method. According to the traffic information detection method of the present invention, at least one loop coil on a road transmits a signal indicative of electric change induced in the loop coil by a vehicle, at least one loop detection device installed at the garden or escape zone of the road receives the signal transmitted from the loop coil and wirelessly transmits a signal indicative of whether or not a vehicle exists on a road, the velocity of and type of the vehicle, and a traffic signal controller wirelessly receives the signal transmitted from the loop detection device, thereby acquiring traffic information.

7 Claims, 10 Drawing Sheets

(56) References Cited

U.S. PATENT DOCUMENTS

| | | | | |
|---|---|---|---|---|
| 2004/0056778 | A1 | 3/2004 | Hilliard | |
| 2005/0062617 | A1 | 3/2005 | Dalgleish | |
| 2006/0170567 | A1* | 8/2006 | Dalgleish | 340/933 |
| 2007/0250240 | A1 | 10/2007 | Reisner | |
| 2007/0254687 | A1* | 11/2007 | Nassimi | 455/550.1 |
| 2010/0026520 | A1* | 2/2010 | Witte et al. | 340/908 |

* cited by examiner

TRAFFIC INFORMATION DETECTION SYSTEM AND METHOD THEREOF

CROSS-REFERENCE OF RELATED APPLICATIONS

The present application is a continuation-in-part application of currently U.S. patent application Ser. No. 12/298,296 filed on Apr. 30, 2007, now abandoned titled "TRAFFIC INFORMATION DETECTION SYSTEM AND METHOD THEREOF", which is a national stage application of PCT/KR07/02114 and which claims the priority benefit of Korean Patent Application No. 10-2006-0042503, filed on May 11, 2006 in the Korean Intellectual Property Office, each of which is incorporated herein by reference its entirety.

TECHNICAL FIELD

An embodiment of the present invention relates to a traffic information detection system and method, and more particularly to a traffic information detection system and method for solving a connection line cut-off problem between a loop coil and a loop detection device, which occurs due to unavoidable pavement excavation for gas, electric or communication line construction, by changing the position of the loop detection device from the existing roadside to the central line of a load or a safe area in the road.

BACKGROUND ART

In general, loop coils and loop detection devices are frequently used so as to detect traffic information, such as whether or not a vehicle exists, and the travel velocity and type of a vehicle. Such a loop detection device detects the change of inductance produced in one or more loop coils by the movement of a vehicle or the like, thereby detecting the traffic information, such as whether or not a vehicle exists, the travel velocity and type of the vehicle. It has been reported that the change of inductance in such a loop coil is not affected by the road icing, the change of temperature and moisture, the change of sunlight hours, the characteristic change of a road surface, etc., and the loop coil detection devices as mentioned above have a reliability of no less than 99% under a practical environment.

The existing loop detection devices include one loop coil or two or more loop coils provided in a predetermined distance with the same purpose in a lane or place or a road, for which detection is desired, wherein the one loop coil or the two or more loop coils are installed in one or more lanes. The loop coils installed in each lane are connected to a loop detection device installed on the roadside, and the loop detection device transmits detected data to a traffic signal controller. At this time, the data processed in the loop detection device is transmitted to the traffic signal controller in a wired or wireless manner.

FIG. 1 shows a configuration of a conventional wired type traffic information detection system.

As shown in FIG. 1, the conventional wired type traffic information detection system transfers the change of inductance induced in a stop line sensing loop coil 2 and/or a straight ahead direction interruption sensing loop coil 3 by a vehicle to a loop detection device 4 installed in the roadside through a wire. The loop detection device 4 detects the electric change received from the loop coil 3, thereby detecting traffic information, such as whether or not a vehicle exists, the travel velocity and type of the vehicle, etc. The loop detection device 4 transmits detected data to a traffic signal controller 1 (an in-situ controller or a VDS controller) through a wire or the loop coil 2 is directly connected to a loop detection device existing within the traffic signal controller 1 through a wire so that the traffic information is processed on the basis of the signal outputted from the loop coil 2.

FIG. 2 shows a configuration of a conventional wireless type traffic information detection system.

As shown in FIG. 2, the conventional wireless type traffic information detection system wirelessly transmits electric change induced by a vehicle in a stop line sensing loop coil 12 and/or a straight ahead direction interruption sensing loop coil 13 provided in a lane or place, for which detection is desired, to a corresponding loop detection device 14 installed at a road side. The loop detection device 14 detects the electric change received from the loop coils 13, thereby detecting traffic information, such as whether or not a vehicle exists, and the travel velocity and type of the vehicle, etc. The loop detection device 14 wirelessly transmits the detected data to a traffic signal controller 11 (an in-situ controller or a VDS controller) with a transceiving antenna. The traffic signal controller 11 receives the data through the antenna and then converts the signal outputted by the loop coils by using an internal conversion device. Thereafter, the traffic controller 11 inputs the converted signal into a traffic information extraction device (not shown) within the traffic signal controller 11 so that the traffic information can be acquired.

However, with the above-mentioned conventional traffic information detection systems, the lifespan of a loop detection device is very short regardless of whether or not the loop detection device employs the wired communication type or the wireless communication type because the gas, electric or communication line construction frequently performed in the roadside or the pavement improvement or repair work causes a connection line cut-off between one or more loop coils installed on the lanes of the road and the loop detection device positioned at the roadside. This is the common problem of the conventional wired type and wireless type traffic information detection systems based on the existing installation method of connecting a lead-in wire of each loop coil to a loop detection device or a traffic signal controller installed at the roadside. Consequently, there is a problem in that a great public cost is wasted as the provisions installed at an enormous cost become useless due to a connection line cut-off occurring between a loop coil and a loop detection device as described above.

SUMMARY

An embodiment of the present invention has been made in order to solve the above-mentioned problems, and an embodiment of the present invention provides a traffic information detection system and method solving the connection line cut-off problem occurring between a loop coil and a loop detection device when pavement is unavoidably excavated for gas, electric or communication line construction by changing the position of the loop detection device from the existing roadside to the central line of the road or a safety zone in the road.

In accordance with an aspect of the present invention, there is provided a traffic information detection system comprising: at least one loop coil installed so as to detect whether or not a vehicle exists on a road, and the travel velocity and type of the vehicle; a loop detection device receiving a signal indicative of the electric change induced in the loop coil by a vehicle so as to determine whether or not a vehicle exists on a road, and the velocity and type of the vehicle, the loop detection device being installed at the central line or a safety zone of the road; and a traffic signal controller wirelessly receiving the signal detected by the loop detection device so as to acquire traffic information.

According to another aspect of the present invention, there is provided a traffic information detection system comprising: at least one loop coil installed so as to detect whether or not a vehicle exists on a road, and the travel velocity and type of the vehicle; a loop detection device receiving a signal indicative of the electric change induced in the loop coil by a vehicle so as to determine whether or not a vehicle exists on a road, and the velocity and type of the vehicle, the loop detection device being installed at the central line or a safety zone of the road; a traffic signal controller wirelessly receiving the signal determined by the loop detection device, thereby acquiring traffic information; and a wireless repeating means for wirelessly repeating signal-transceiving between the loop detection device and the traffic signal controller.

The loop detection device may comprise: at least one solar cell plate installed at the central line or the safety zone of the road; an exchangeable primary battery for supplying power to an internal circuitry of the loop detection device; an electric energy accumulation means for accumulating power received from the solar cell plate so as to extend the lifespan of the primary battery; an ID storage unit for storing the identification (ID) of the loop detection device; and a loop detector circuit unit receiving power from the primary battery and the electric energy accumulation means, the loop detector circuit unit detecting a loop characteristic change produced in at least one loop, packeting the detected result with the ID stored in the ID storage unit, and transmitting the packeted data through a wireless transceiving unit.

There are provided two or more solar cell plates which are connected preferably in parallel with each other and electrically isolated from each other.

The loop detection device preferably transceives a signal through an antenna built in an instrument enclosing the loop detection device.

When no signal is transceived, the wireless transceiving unit preferably automatically controls the power supply so as to suppress power consumption.

The wireless repeating means may include at least one wireless repeater or a loop detection device with a wireless repeating function.

Said at least one loop coil may comprise: a stop line detection loop coil for detecting a stop line; a straight ahead direction interruption detection loop coil for detecting the vehicle's interruption in the straight ahead direction; and a vehicle's travel velocity and length detection loop coil for detecting the travel velocity and length of a vehicle.

According to another aspect of the present invention, there is provided a traffic information detection method, wherein at least one loop coil on a road transmits a signal indicative of electric change induced in the loop coil by a vehicle, at least one loop detection device installed at the central line or a safety zone of the road receives the signal transmitted from the loop coil and wirelessly transmits a signal indicative of whether or not a vehicle exists on a road, the travel velocity and type of the vehicle, and a traffic signal controller wirelessly receives the signal transmitted from the loop detection device, thereby acquiring traffic information.

Here, signal-transceiving between the loop detection device and the traffic signal controller may be repeated through at least one wireless repeating means.

According to the traffic information detection system and method of embodiments of the present invention, the position of a loop detection device is changed from the existing roadside to the central line of the road or a safety zone in the road. As a result, it is possible to solve the connection line cut-off problem between a loop coil and the loop detection device, which is caused by unavoidable pavement excavation performed for gas, electric or communication line construction.

In the past, a connection line between a loop coil installed on a road and a loop detection device installed at the roadside was frequently cut off due to gas, electric or communication line construction frequently performed at an area adjacent to the edges of the road after the installation of a loop detection systems was, or due to pavement improvement or repair work. As a result, a great cost was wasted so as to maintain and repair a lead-in wire between the loop coil and loop detection device, and such a loop detection system became out of order.

However, according to the loop detection system of an embodiment of the present invention, because a loop detection device is installed at the central line or a safety zone of the road, so that a connection line between a loop coil and the loop detection device is not cut off even if unavoidable pavement excavation for gas, electric or communication line construction or pavement improvement or repair work is performed. Therefore, it is possible to greatly extend the lifespan of such a loop detection system. In addition, a power source for the loop detection device is formed by an exchangeable primary battery, an electric energy accumulation means using solar light and employing a plurality of solar cell plates connected in parallel, so that the influence exerted on the loop detection system by the connection line cut-off caused by the fracture of a solar cell plate can be minimized. As a result, the loop detection system can be stably operated for a long time once it is installed.

Furthermore, it is possible to dramatically reduce the construction cost required for transferring traffic information detected by a loop detection device positioned beyond a predetermined distance from a traffic signal controller, from the loop detection device to the traffic signal controller.

BRIEF DESCRIPTION OF THE DRAWINGS

The foregoing and other objects, features and advantages of embodiments of the present invention will become more apparent from the following detailed description when taken in conjunction with the accompanying drawings in which.

DETAILED DESCRIPTION

Hereinafter, exemplary embodiments of the present invention will be described with reference to the accompanying drawings.

First Embodiment of Traffic Information Detection System

Figure 4:
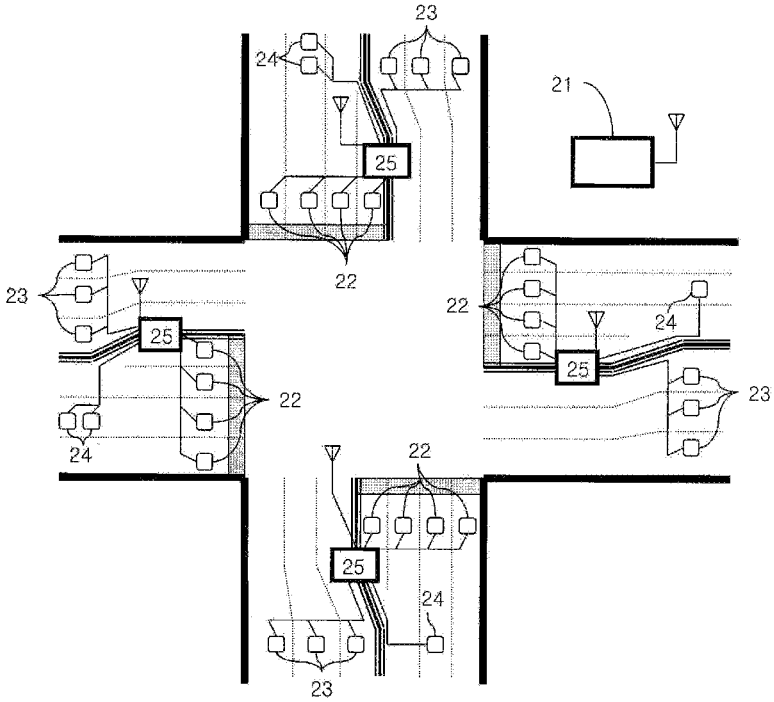
FIG. 4 shows a configuration of a traffic information detection system according to a first embodiment of the present invention.

FIG. 4 shows a configuration of a traffic information detection system according to a first embodiment of the present invention.

As shown in FIG. 4, the traffic information detection system comprises: at least one stop line detection loop coil 22 for detecting a stop line, at least one straight ahead direction interruption detection loop coil 23 for detecting interruption in the straight ahead direction; and at least one vehicle's travel velocity and length detection loop coil 24 for detecting the travel velocity and length of a vehicle running in an interested lane of a road, wherein each of the loop coils 22, 23 and 24 is installed in a desired lane or place, and a signal indicative of an electric change induced in any of the loop coils 22, 23 and 24 by a vehicle is transmitted to a loop detection device 25 through a wire, the loop detection device 25 being installed at the central line or a safety zone of the road.

The loop detection device 25 detects the electric change induced in the loop coils 22, 23 and 24, thereby determining traffic information, such as whether or not a vehicle exists, the travel velocity and type of the vehicle, etc. In addition, the loop detection device 25 wirelessly transfers the detected data to a traffic signal controller 21 (an in-situ controller or VDS controller) using a transceiving antenna. The traffic controller 21 receives the data through the antenna, then converts the signals outputted from the loop coils by using an internal conversion device, and then inputs the converted signals into a traffic information extraction device (not shown) within the traffic signal controller 21 so as to acquire traffic information.

Meanwhile, if a crossroad is not provided with a U-turn lane but is provided with a left-turn lane, the loop detection device 25 is installed at the central line or a safety zone of a road, adjacent to the central area of the crossroad. If the crossroad is provided with left-turn and U-turn lanes, such the detection unit 25 is installed at the central line or a safety zone of a road, which is positioned near the corresponding loop coils, among the areas in which vehicles are not allowed to U-turn. At this time, it is possible to provide retroreflective raised pavement markers so as to prevent the crossing of vehicles, so that the loop detection device 25 installed on the road surface is not loaded by the vehicles.

There are provided one or more vehicle's travel velocity and length detection loop coils 24 for detecting the travel velocity and length of a vehicle traveling along an interested lane, wherein the loop coils are installed to be spaced by a predetermined distance in the interested lane, and two signal lines connected to two loop coils are connected to the loop detection device 25 installed at the central line of the road or a safety zone in the road adjacent to the loop coils so as to transceive the detected traffic information.

Second Embodiment of Traffic Information Detection System

Figure 5:
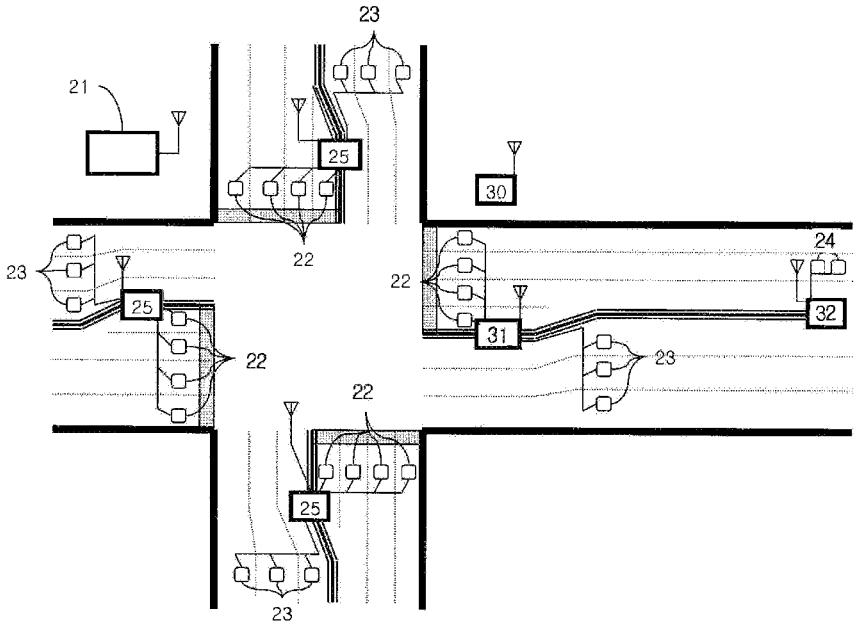
FIG. 5 shows a configuration of a traffic information detection system according to a second embodiment of the present invention.

FIG. 5 shows a configuration of a traffic information detection system according to a second embodiment of the present invention.

As shown in FIG. 5, the traffic information detection system comprises: at least one stop line detection loop coil 22 for detecting a stop line, at least one straight ahead direction interruption detection loop coil 23 for detecting the vehicle's interruption in the straight ahead direction; and at least one vehicle's travel velocity and length detection loop coil 24 for detecting the travel velocity and length of a vehicle running in an interested lane of a road, wherein the loop coils 22, 23 and 24 are installed in a desired lane or place, and the electric changes induced in the loop coils 22, 23 and 24 by a vehicle are transferred to first to third loop detection devices 25, 31 and 32 through one or more wires, respectively, wherein the first to third loop detection devices 25, 31 and 32 are installed at the central line or a safety zone of the road.

The first to third loop detection devices 25, 31 and 32 detect the electric changes received from the loop coils 22, 23 and 24 so as to determine traffic information, such as whether or not a vehicle exists, the travel velocity and type of the vehicle, etc.

Figure 1:
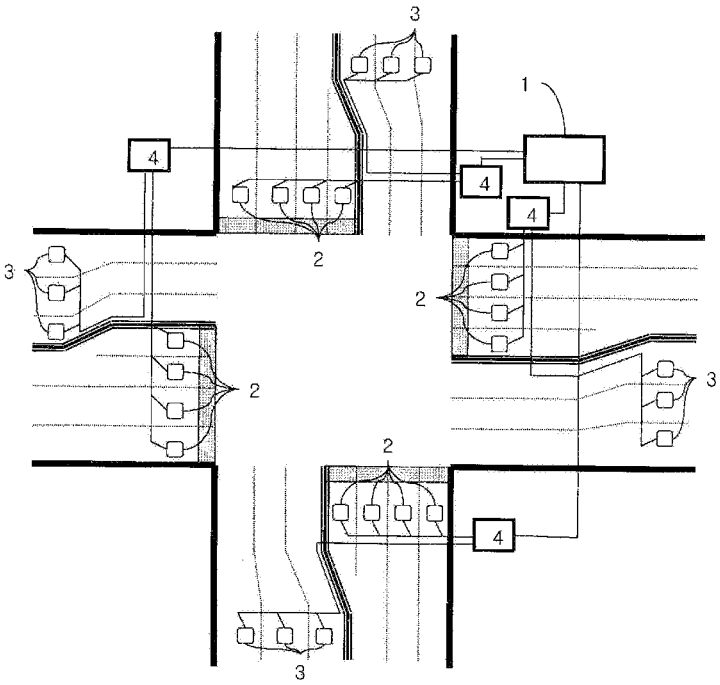
FIG. 1 (Background Art)
FIG. 1 shows a configuration of a conventional wired type traffic information system.
Figure 2:
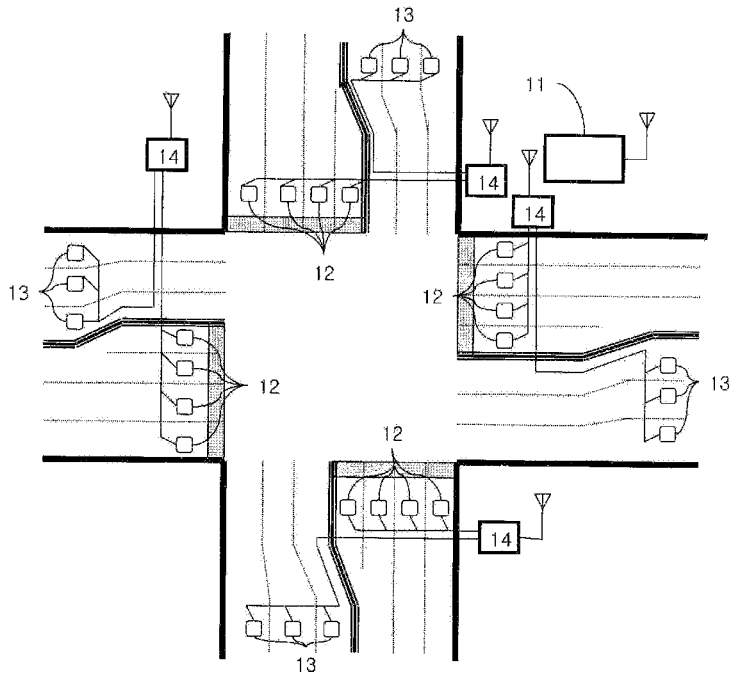
FIG.2 (Background Art)
FIG. 2 shows a configuration of a conventional wireless type traffic information system.
Figure 3:
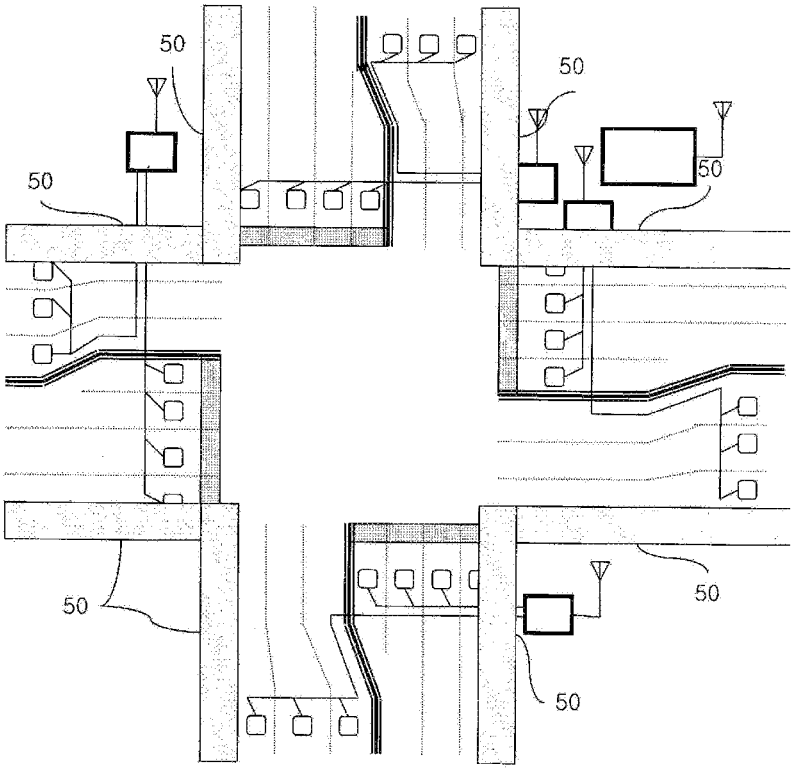
FIG. 3 shows a view for describing a problem of a conventional traffic information system.

At this time, the first and second loop detection devices 25 and 31 are positioned within a predetermined distance from a traffic signal controller 21 (an in-situ controller or a VDS controller), and the third loop detection device 32 is positioned beyond the predetermined distance from the traffic signal controller 21. Therefore, the first and second loop detection devices 25 and 31 positioned within the predetermined distance from the traffic signal controller 21 directly wirelessly transmit the data detected by the loop coils using the transceiving antenna, and the third loop detection device 32 positioned beyond the predetermined distance from the traffic signal controller 21 transmits the data detected by the loop coils to a wireless repeater 30 (including a traffic signal controller capable of wireless repeating and a single traffic signal controller) located at a predetermined distance from the third loop detection device 32 or a loop detection device with a repeating function (for example, that indicated by reference numeral 31 in FIG. 3) positioned adjacent to the third loop detection device 32. In addition, the wireless repeater 30 or the adjacent loop detection device 31 wirelessly repeats the data received from the third loop detection device 32 to the traffic signal controller 21.

The traffic controller 21 receives data through the antenna, then converts the signals outputted from the loop coils by using an internal conversion device, and then inputs the converted signals into a traffic information extraction device (not shown) within the traffic signal controller 22, thereby acquiring traffic information.

Meanwhile, if a crossroad is not provided with a U-turn lane but is provided with a left-turn lane, the loop detection device 25 is installed at the central line or a safety zone of the road, adjacent to the central area of the crossroad. If the crossroad is provided with left-turn and U-turn lanes, such a loop detection unit 25 is installed at the central line or a safety zone of the road near the corresponding loop coils in the area in which vehicles are not allowed to U-turn. At this time, it is possible to provide retroreflective raised pavement markers so as to prevent the crossing of vehicles, so that the loop detection device 25 on the road surface is not loaded by the vehicles.

There are provided one or more vehicle's travel velocity and length detection loop coils 24 for detecting the travel velocity and length of a vehicle traveling along an interested lane, wherein the loop coils 24 are installed to be spaced by a predetermined distance in the interested lane, and two signal lines connected to two loop coils are connected to the third loop detection device 32 installed at the central line of the road or in the safety zone in the road adjacent to the loop coils so as to transceive the detected traffic information.

Loop Detection Device

Figure 6:
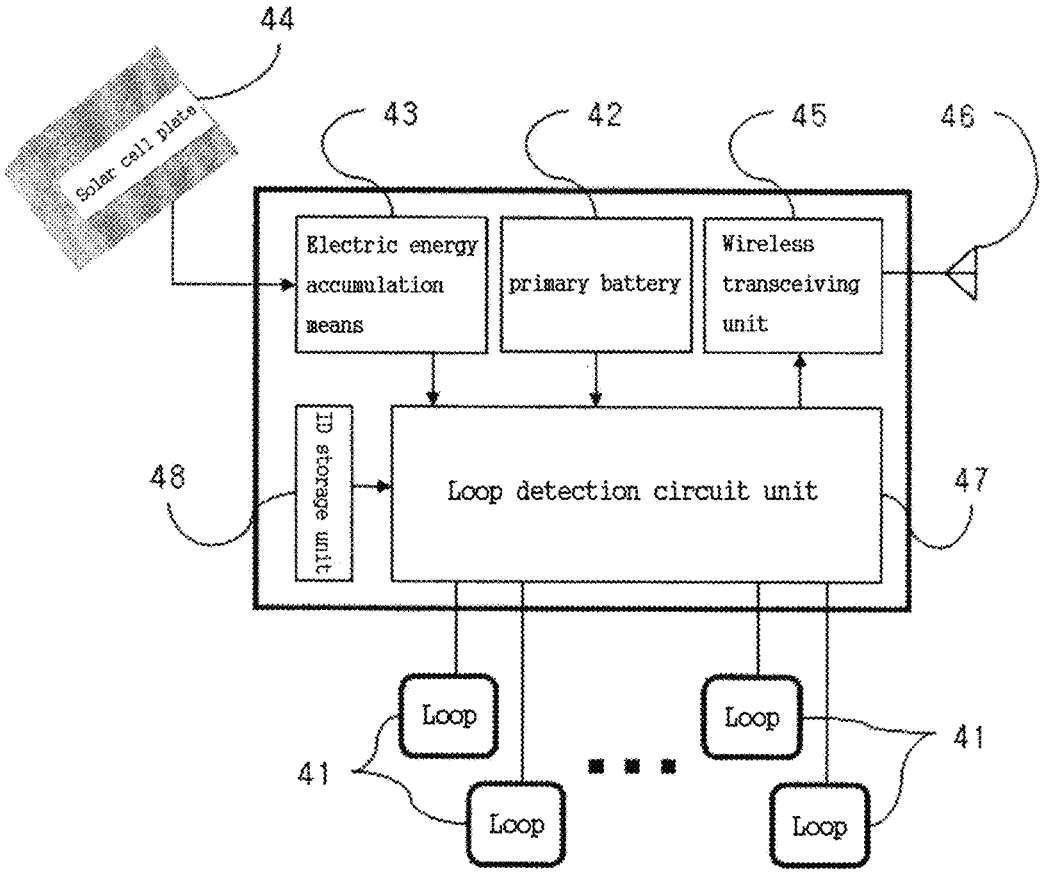
FIG. 6 shows an internal configuration of a loop detection device according to an embodiment of the present invention

FIG. 6 shows an internal configuration of a loop device according to an embodiment of the present invention.

As shown in FIG. 6, the loop detection device comprises: a plurality of solar cell plates 44 installed in parallel at the central line or a safety zone on a road; a primary battery 42 for supplying power to the internal device; an electric energy accumulation means 43 (a secondary battery or a high capacity capacitor) for accumulating power received from the solar cell plates 44 so as to extend the lifespan of the primary battery 42; and a loop detector circuit unit 47 receiving power supplied from the primary battery 42 and the electric energy accumulation means 43, the loop detector circuit unit 47 detecting a loop characteristic change produced one or more loops 41, and packeting and transmitting the detected data through a wireless transceiving unit 45.

Figure 7:
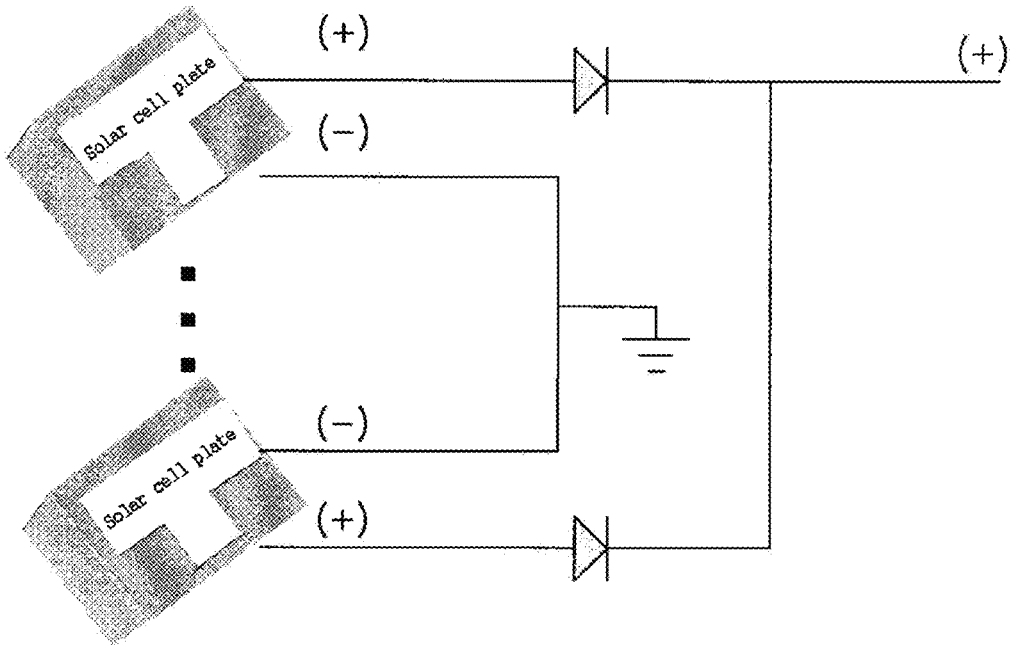
FIG. 7 shows a connection circuitry of a solar cell plate of the inventive loop detection device.
Figure 8:
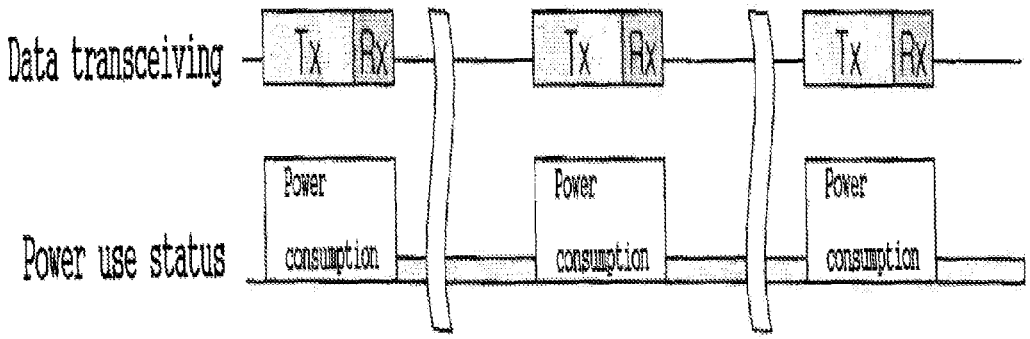
FIG. 8 shows a schematic view showing a method and effect of cutting off a power source of a wireless transceiving unit for the purpose of saving electric power in the inventive loop detection device.

As described above, the loop detection device includes a primary battery 42 and an electric energy accumulation means 43 so as to extend the lifespan of the primary battery 42, and the power source is provided in a doubly powered construction so as to secure the minimum period for continuously using the primary battery without exchange. The solar cell plates 44 connected to the electric energy accumulation means 43 are configured to be installed at the central line or a safety zone of road so that they do not affect the traffic flow. In addition, in order to supply sufficient power to the loop detection device, the solar cell plates 44 are arranged in such a manner that even if one or more solar cell plates 44 are fractured, they do not affect the other solar cell plates 44 when the solar cell plates are connected in parallel. That is, in order to minimize the influence affected to the power supply from the solar cell plates 44 in a state in which one or more solar cells 44 are fractured or a power supply line is cut off, thereby disabling the power supply, the solar cell plates 44 are electrically isolated from each other as shown in FIG. 7. If the current capacity of basic solar cells is insufficient due to a geographical condition, it is possible for the solar cell plates 44 to employ a solar cell installation instrument (not shown) for extending the parallel connection thereof.

In addition, the primary battery 42 consumed due to the lapse of period can be removed from an instrument of the loop detection device installed on the road surface by a predetermined method, so that the primary battery 42 be exchanged into a new one.

The loop detector circuit unit 47 receives power from the primary battery 42 and the electric energy accumulation means 43, wherein the loop detector circuit unit 47 uses the power from the electric energy accumulation means 43 prior to that from the primary battery 42, so that the consumption of the primary battery 42 is minimized. The loop detector circuit unit 47 detects the loop characteristic change received from at least one loop 41, packets the detected result with the ID stored in the ID storage unit 48, and transmits the packeted data through the wireless transceiving unit 45. The antenna connected to the wireless transceiving unit 45 is adapted not to project from an instrument enclosing the loop detection device, so that the malfunction or the like of the antenna 46 caused by the cut-off of a line connected to the antenna can be minimized.

In order to reduce the power consumption, the loop detection device 25 turns on the wireless transceiving unit 45 at the time when traffic information to be transmitted is detected, waits until the operation of the wireless transceiving unit 45 is stabilized, transmits information accumulated till that time through the antenna, and then awaits acknowledgement (ACK) from the traffic signal controller 21 receiving the information for the maximum permitted time period permitted to the traffic signal controller 21 for sending the acknowledgement (ACK).

After receiving the acknowledgement from the traffic signal controller 21, the loop detection device 25 changes its mode so as to cut off the power supply of the wireless transceiving unit 45, thereby minimizing the power consumption while wireless transceiving is not executed.

Third Embodiment of Traffic Information Detection System

Figure 9:
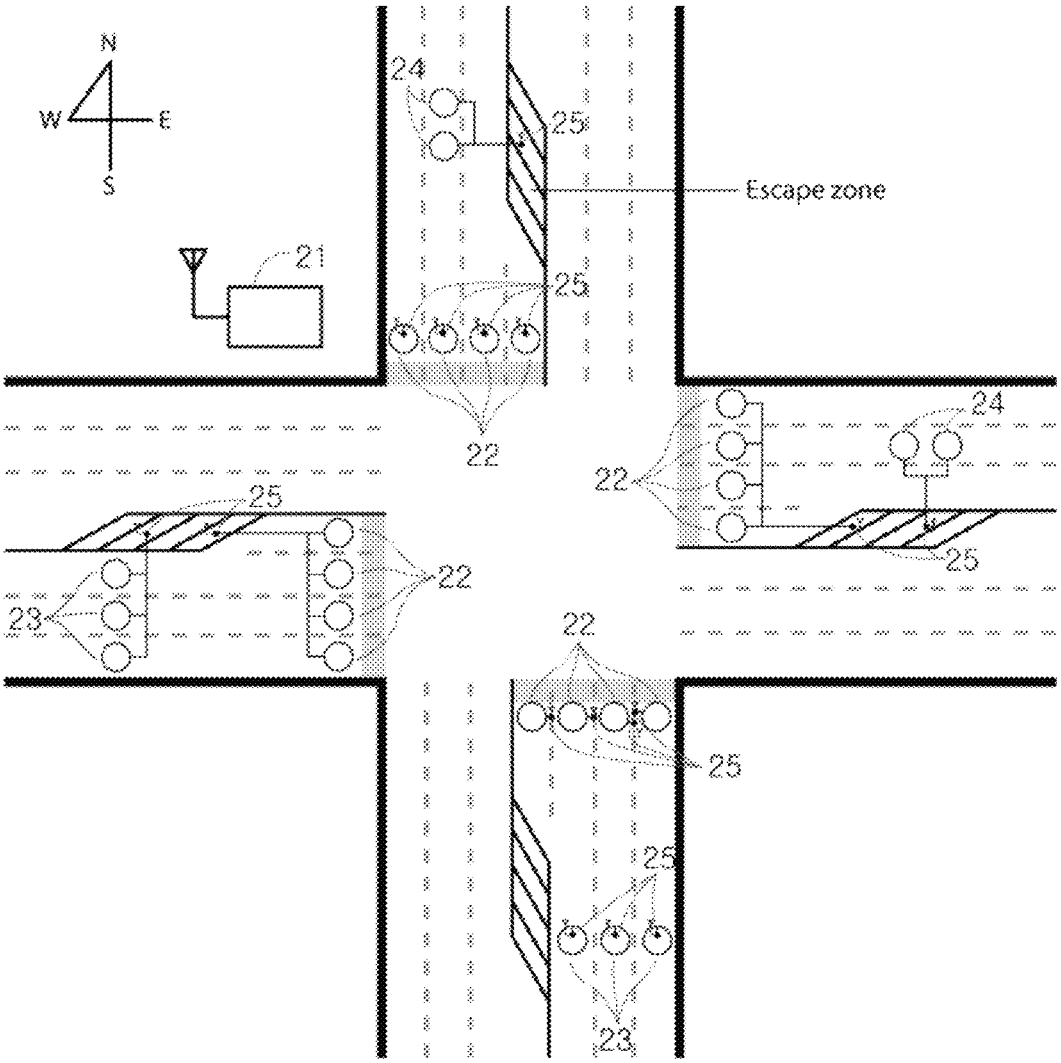
FIG. 9 shows a configuration of a traffic information detection system according to a third embodiment of the present invention.

FIG. 9 shows a configuration of a traffic information detection system according to a third embodiment of the present invention.

As shown in FIG. 9, the traffic information detection system comprises: at least one stop line detection loop coil 22 for detecting a stop line, at least one straight ahead direction interruption detection loop coil 23 for detecting interruption in the straight ahead direction; and at least one vehicle's travel velocity and length detection loop coil 24 for detecting the travel velocity and length of a vehicle running in an interested lane of a road, wherein each of the loop coils 22, 23 and 24 is installed in a desired lane or place, and a signal indicative of an electric change induced in any of the loop coils 22 and 24 by a vehicle is transmitted to the corresponding loop detection device 25 via a wire(s).

In the present embodiment, some of the loop detection devices 25 are installed at a safety zone formed adjacent to or at a central region of the road. This safety zone serve as a vehicle escape zone which the vehicle runs into and stops at when encountering emergency situations. This vehicle escape zone extends in the driving direction of the vehicle on the road. As a result, it is possible to solve the connection line cut-off problem between the loop coil and the loop detection device, which is caused by unavoidable pavement excavation performed for gas, electric or communication line construction.

In the present embodiment, some of the loop detection devices 25 are installed adjacent to the corresponding loop coils respectively in a corresponding lane. As a result, it is possible to solve the connection line cut-off problem between the loop coil and the loop detection device, which is caused by unavoidable pavement excavation performed for gas, electric or communication line construction.

More specifically, in this present embodiment, at a north side road from the cross road, each of the stop line detection loop coils 22 is communicated with, via wires, each of corresponding loop detection devices 25 adjacent to each of the corresponding coils 22 in a corresponding lane. The loop detection device 25 may be positioned within the close loop of the loop coil 22 as shown in this figure or otherwise outside of the close loop of the loop coil 22. Meanwhile, two vehicle's travel velocity and length detection loop coils 24 are situated in the same line and connected, via a wire, to the corresponding loop detection device 25 located in the vehicle escape zone adjacent to or at the central region of the drivable road.

In case of the loop detection devices 25 adjacent to each of the corresponding coils 22 in a corresponding lane, the device may not have a plurality of solar cell plates 44 and an electric energy accumulation means 43 (a secondary battery or a high capacity capacitor) for accumulating power received from the solar cell plates 44, as shown in FIG. 6. The device 25 may be buried in the road so that a portion thereof including an antenna may be exposed to the outside.

In this present embodiment, at a south side road from the cross road, each of the stop line detection loop coils 22 is communicated with, via wires, each of corresponding loop detection devices 25 adjacent to each of the corresponding coils 22 in a corresponding lane. In this example, the loop detection device 25 is positioned outside of the close loop of the loop coil 22. Meanwhile, each of the straight ahead direction interruption detection loop coils 23 in the corresponding lanes are connected via wires with the corresponding loop detection devices 25 adjacent to each of the corresponding coils 23 in a corresponding lane. In this example, the loop detection device 25 is positioned within the close loop of the loop coil 22. In FIG. 9, each of the loop coils has a circular shape loop but the present invention is not limited thereto. For example, the shape of the loop coil may be polygonal.

In this present embodiment, at a west side road from the cross road, each of the stop line detection loop coils 22 is communicated with, via wires, one loop detection device 25 located in the vehicle escape zone adjacent to or at the central region of the drivable road. Meanwhile, each of the straight ahead direction interruption detection loop coils 23 in the corresponding lanes are connected via wires with the other loop detection device 25 located in the vehicle escape zone adjacent to or at the central region of the drivable road.

In this present embodiment, at an east side road from the cross road, each of the stop line detection loop coils 22 is communicated with, via wires, one loop detection device 25 located in the vehicle escape zone adjacent to the central line of the drivable road. Meanwhile, two vehicle's travel velocity and length detection loop coils 24 are situated in the same line and are connected via wires with the other loop detection device 25 located in the vehicle escape zone adjacent to or at the central region of the drivable road.

The loop detection device 25 detects the electric change induced in the loop coils 22, 23 and 24, thereby determining traffic information, such as whether or not a vehicle exists, the travel velocity and type of the vehicle, etc. In addition, the loop detection device 25 wirelessly transfers the detected data to a traffic signal controller 21 (an in-situ controller or VDS controller) using a transceiving antenna. The traffic controller 21 receives the data through the antenna, then converts the signals outputted from the loop coils by using an internal conversion device, and then inputs the converted signals into a traffic information extraction device (not shown) within the traffic signal controller 21 so as to acquire traffic information.

Fourth Embodiment of Traffic Information Detection System

Figure 10:
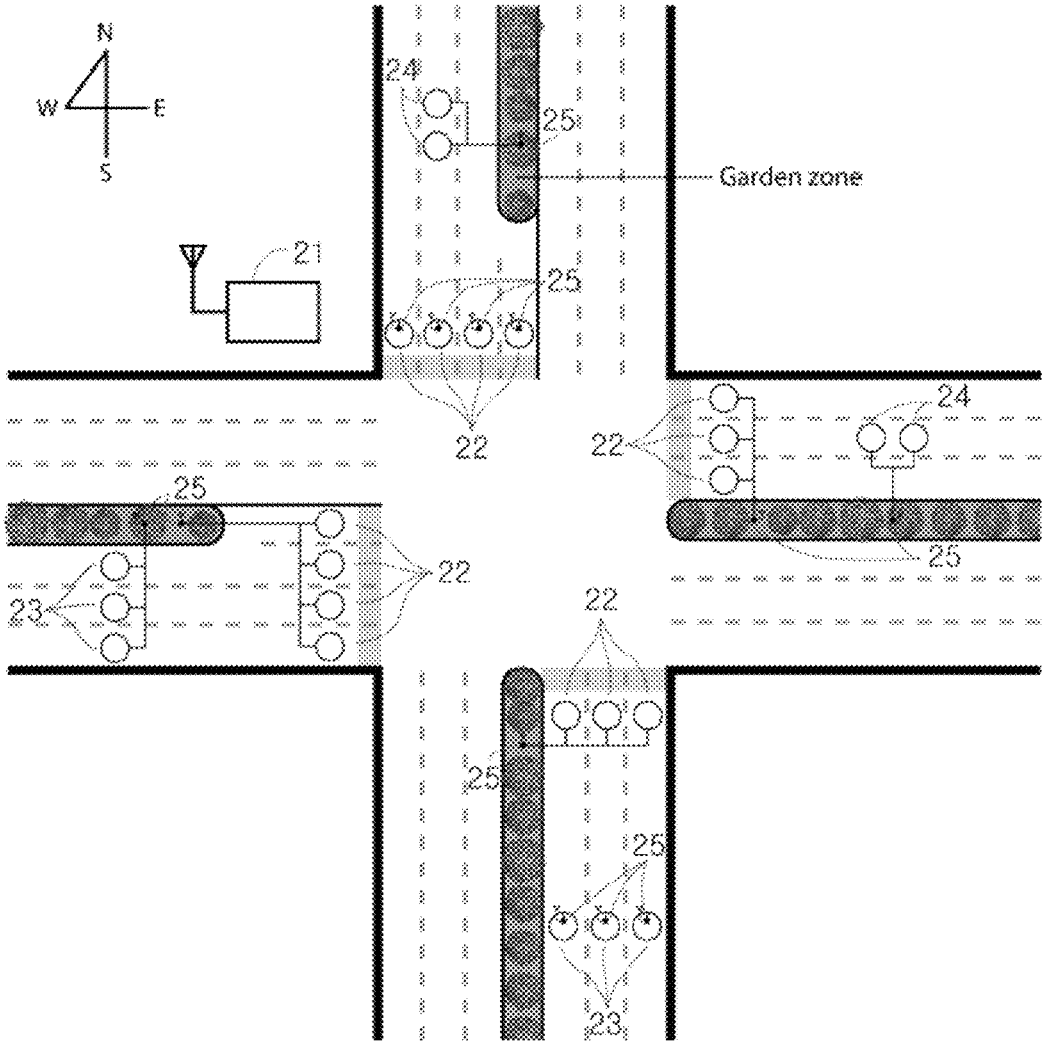
FIG. 10 shows a configuration of a traffic information detection system according to a fourth embodiment of the present invention.

FIG. 10 shows a configuration of a traffic information detection system according to a fourth embodiment of the present invention.

As shown in FIG. 10, the traffic information detection system comprises: at least one stop line detection loop coil 22 for detecting a stop line, at least one straight ahead direction interruption detection loop coil 23 for detecting interruption in the straight ahead direction; and at least one vehicle's travel velocity and length detection loop coil 24 for detecting the travel velocity and length of a vehicle running in an interested lane of a road, wherein each of the loop coils 22, 23 and 24 is installed in a desired lane or place, and a signal indicative of an electric change induced in any of the loop coils 22 and 24 by a vehicle is transmitted to the corresponding loop detection device 25 via a wire(s).

In the present embodiment, some of the loop detection devices 25 are installed at a garden zone formed adjacent to or at a central region of the road. This garden zone may include various plants, trees, grass and/or lawn planted therein. This garden zone may provide the road with aesthetical and/or health-friendly environments. This garden zone may extend in the driving direction of the vehicle on the road. As a result, it is possible to solve the connection line cut-off problem between the loop coil and the loop detection device, which is caused by unavoidable pavement excavation performed for gas, electric or communication line construction.

In the present embodiment, some of the loop detection devices 25 are installed adjacent to the corresponding loop coils respectively in a corresponding lane. As a result, it is possible to solve the connection line cut-off problem between the loop coil and the loop detection device, which is caused by unavoidable pavement excavation performed for gas, electric or communication line construction.

More specifically, in this present embodiment, at a north side road from the cross road, each of the stop line detection loop coils 22 is communicated with, via wires, each of corresponding loop detection devices 25 adjacent to each of the corresponding coils 22 in a corresponding lane. The loop detection device 25 may be positioned within the close loop of the loop coil 22 as shown in this figure or otherwise outside of the close loop of the loop coil 22. Meanwhile, two vehicle's travel velocity and length detection loop coils 24 are situated in the same line and connected, via a wire, to the corresponding loop detection device 25 located in the garden zone adjacent to or at the central region of the drivable road.

In case of the loop detection devices 25 adjacent to each of the corresponding coils 22 in a corresponding lane, the device 25 may not have a plurality of solar cell plates 44 and an electric energy accumulation means 43 (a secondary battery or a high capacity capacitor) for accumulating power received from the solar cell plates 44, as shown in FIG. 6. The device 25 may be buried in the road so that a portion thereof including an antenna may be exposed to the outside.

In this present embodiment, at a south side road from the cross road, each of the straight ahead direction interruption detection loop coils 23 in the corresponding lanes are connected via wires with the corresponding loop detection devices 25 adjacent to each of the corresponding coils 23 in a corresponding lane. In this example, the loop detection device 25 is positioned within the close loop of the loop coil 22. In FIG. 10, each of the loop coils has a circular shape loop but the present invention is not limited thereto. For example, the shape of the loop coil may be polygonal. Meanwhile, each of the stop line detection loop coils 22 is communicated with, via wires, one loop detection device 25 located in the garden zone adjacent to or at the central region of the drivable road.

In this present embodiment, at a west side road from the cross road, each of the stop line detection loop coils 22 is communicated with, via wires, one loop detection device 25 located in the garden zone adjacent to or at the central region of the drivable road. Meanwhile, each of the straight ahead direction interruption detection loop coils 23 in the corresponding lanes are connected via wires with the other loop detection device 25 located in the garden zone adjacent to the central line of the drivable road.

In this present embodiment, at an east side road from the cross road, each of the stop line detection loop coils 22 is communicated with, via wires, one loop detection device 25 located in the garden zone adjacent to the central line of the drivable road. Meanwhile, two vehicle's travel velocity and length detection loop coils 24 are situated in the same line and are connected via wires with the other loop detection device 25 located in the garden zone adjacent to the central line of the drivable road.

The loop detection device 25 detects the electric change induced in the loop coils 22, 23 and 24, thereby determining traffic information, such as whether or not a vehicle exists, the travel velocity and type of the vehicle, etc. In addition, the loop detection device 25 wirelessly transfers the detected data to a traffic signal controller 21 (an in-situ controller or VDS controller) using a transceiving antenna. The traffic controller 21 receives the data through the antenna, then converts the signals outputted from the loop coils by using an internal conversion device, and then inputs the converted signals into a traffic information extraction device (not shown) within the traffic signal controller 21 so as to acquire traffic information.

Although several exemplary embodiments of the present invention have been described for illustrative purposes, those skilled in the art will appreciate that various modifications, additions and substitutions are possible, without departing from the scope and spirit of the invention as disclosed in the accompanying claims.

The present invention relates to a traffic information system and method, wherein a position of a loop detection device is changed from the existing roadside to the central line or a safety zone of the road, whereby it is possible to solve a connection line cut-off problem between a loop coil and a loop detection device, which is resulted from unavoidable pavement excavation for a gas, electric or communication line construction.

What is claimed is:

1. A traffic information detection system comprising:

at least one loop coil installed so as to detect whether or not a vehicle exists on a road, and the travel velocity and type of the vehicle;

a loop detection device receiving a signal indicative of the electric change induced in the loop coil by a vehicle so as to determining whether or not a vehicle exists on a road, and the velocity and type of the vehicle, the loop detection device being installed at the central line or a safety zone of the road; and a traffic signal controller wirelessly receiving the signal determined by the loop detection device, thereby acquiring traffic information, wherein the loop detection device comprises: at least one solar cell plate installed at the central line or the safety zone of the road; an exchangeable primary battery for supplying power to an internal circuitry of the loop detection device; an electric energy accumulation means for accumulating power received from the solar cell plate so as to extend the lifespan of the primary battery; an ID storage unit for storing the identification (ID) of the loop detection device; and a loop detector circuit unit receiving power from the primary battery and the electric energy accumulation means, the loop detector circuit unit detecting a loop characteristic change produced in at least one loop, packeting the detected result with the ID stored in the ID storage unit, and transmitting the packeted data through a wireless transceiving unit.

2. Traffic information detection system comprising:

at least one loop coil installed so as to detect whether or not a vehicle exists on a road, and the travel velocity and type of the vehicle;

a loop detection device receiving a signal indicative of the electric change induced in the loop coil by a vehicle so as to determine whether or not a vehicle exists on a road, and the velocity and type of the vehicle, the loop detection device being installed at the central line or a safety zone of the road;

a traffic signal controller wirelessly receiving the signal determined by the loop detection device, thereby acquiring traffic information; and a wireless repeating means for wirelessly repeating signal-transceiving between the loop detection device and the traffic signal controller, wherein the loop detection device comprises: at least one solar cell plate installed at the central line or the safety zone of the road; an exchangeable primary battery for supplying power to an internal circuitry of the loop detection device; an electric energy accumulation means for accumulating power received from the solar cell plate so as to extend the lifespan of the primary battery; an ID storage unit for storing the identification (ID) of the loop detection device; and a loop detector circuit unit receiving power from the primary battery and the electric energy accumulation means, the loop detector circuit unit detecting a loop characteristic change produced in at least one loop, packeting the detected result with the ID stored in the ID storage unit, and transmitting the packeted data through a wireless transceiving unit.

3. The traffic information detection system as claimed in claim 1, wherein there are provided two or more solar cell plates which are connected in parallel with each other and electrically isolated from each other.

4. The traffic information detection system as claimed in claim 1, wherein the loop detection device transceives a signal through an antenna built in an instrument enclosing the loop detection device.

5. The traffic information detection system as claimed in claim 1, wherein when no signal is transceived, the wireless transceiving unit automatically controls the power supply so as to suppress power consumption.

6. The traffic information detection system as claimed in claim 2, wherein the wireless repeating means comprises at least one wireless repeater or loop detection device with a wireless repeating function.

7. The traffic information detection system as claimed in claim 2, wherein the at least one loop coil comprises:

a stop line detection loop coil for detecting a stop line;

a straight ahead direction interruption detection loop coil for detecting the vehicle's interruption in the straight ahead direction; and a vehicle's travel velocity and length detection loop coil for detecting the travel velocity and length of a vehicle.

* * * * *